US005083314A

United States Patent [19]

Andujar

[11] Patent Number: 5,083,314

[45] Date of Patent: Jan. 28, 1992

[54] SPORTS GLOVE

[76] Inventor: Edward M. Andujar, 87 W. Riverside Dr., Mays Landing, N.J. 08330

[21] Appl. No.: 506,062

[22] Filed: Apr. 9, 1990

[51] Int. Cl.[5] ..... A41D 13/10

[52] U.S. Cl. ..... 2/18; 2/161 A

[58] Field of Search ..... 2/18, 20, 161 A, 161 R, 2/167, 16, 159, 160, 163

[56] References Cited

U.S. PATENT DOCUMENTS

| | | | |
|---|---|---|---|
| 3,855,633 | 12/1974 | Rhee | 2/18 |
| 3,945,045 | 3/1976 | Rhee | 2/18 |
| 4,137,572 | 2/1979 | Jansson et al. | 2/161 A |
| 4,287,610 | 9/1981 | Rhee | 2/161 A |
| 4,603,439 | 8/1986 | Golomb | 2/18 |
| 4,635,300 | 1/1987 | Rhee | 2/18 |
| 4,984,300 | 1/1991 | Cho | 2/16 |

*Primary Examiner*—Werner H. Schroeder

*Assistant Examiner*—Amy Vanatta

*Attorney, Agent, or Firm*—John S. Hale

[57] ABSTRACT

A sports glove for use in contact sports comprising a unitary molded body which is constructed with a wrist section, a hand section, and finger and thumb sections. An elastic strap with VELCRO fasteners is secured to the wrist section of the glove and is adapted to encircle the glove so that the strap can be fastened around the wrist portion, holding the wrist portion of the glove around the hand of the wearer. A reinforced thumb member is secured to the thumb section to form a thumb enclosure and a reinforced finger member is secured to the hand section of the glove to form a finger enclosure. A protective pad is secured to the back of the hand portion of the glove covering the ridge bones of the hand and the unitary molded body, thumb member, finger member and protective pad are covered by a smooth uniform plastic coating.

15 Claims, 2 Drawing Sheets

FIG. 1
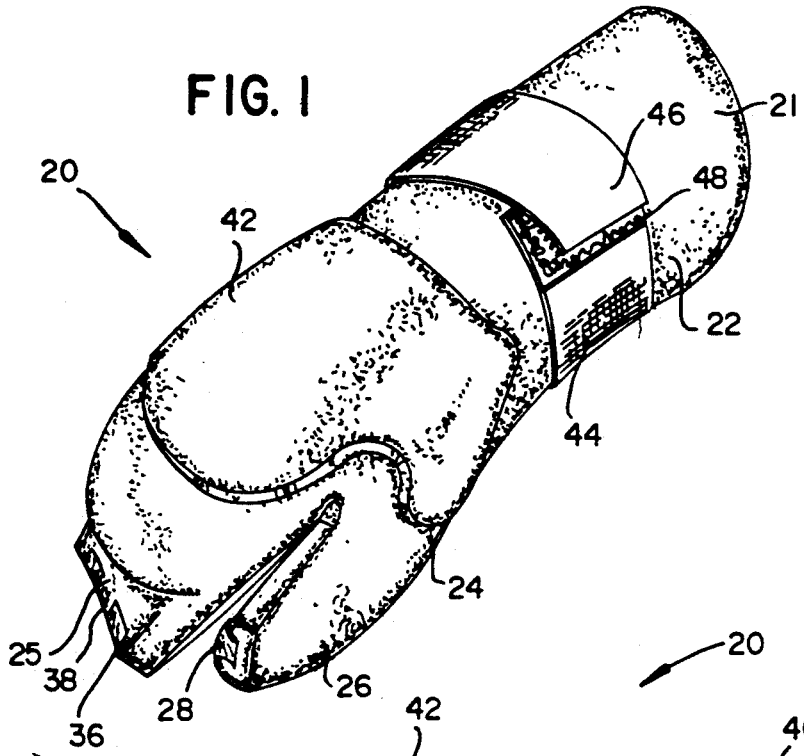
FIG. 2
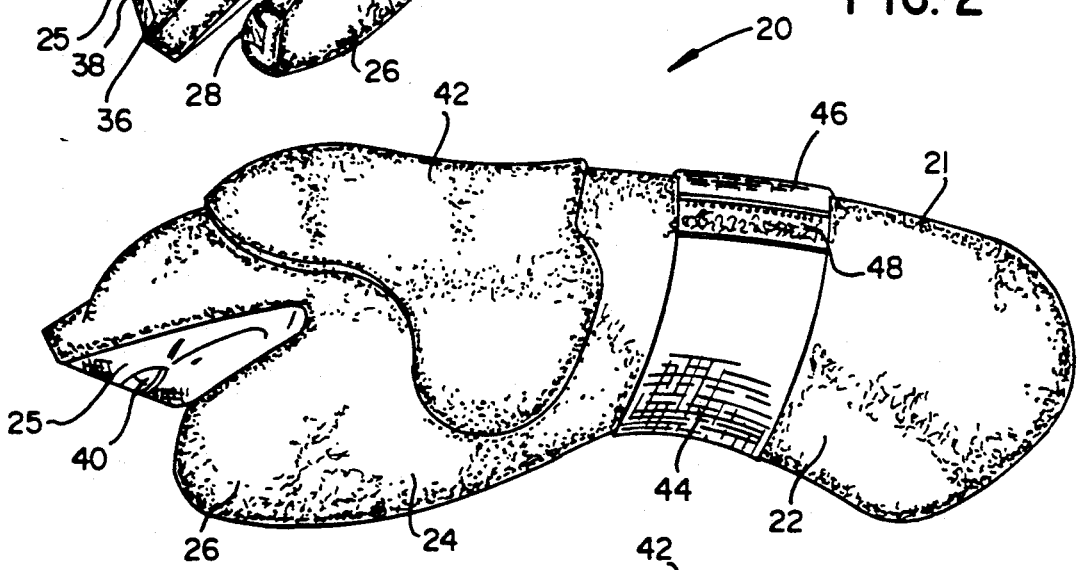
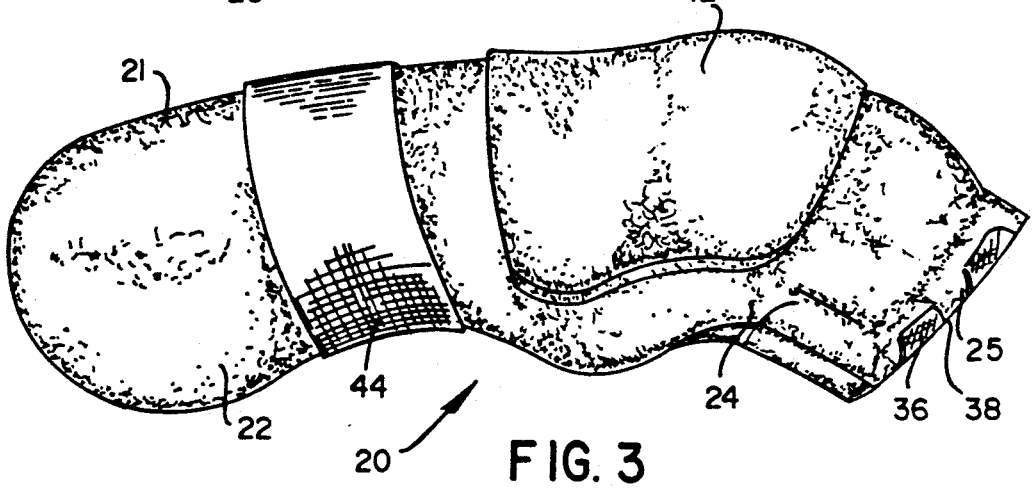
FIG. 3

SPORTS GLOVE

BACKGROUND OF THE INVENTION

1. Field of the Invention

The invention generally relates to protective sports equipment and particularly to protective equipment used in the martial art sports, namely, a karate glove or sports glove.

2. Prior Art

Various types of protective gloves or sports gloves have been developed for use in the martial arts. One pertinent prior art reference, U.S. Pat. No. 4,361,912 discloses a karate glove having a strap which substantially encircles the wrist. The strap is adhesively secured to the wrist portion of the glove body so that the glove does not come open during use. The glove is provided with a closed thumb holder and a finger grab bar extends across the forward portion of the glove so that, when the wearer grasping the bar makes a fist, the fingers are protected by a blunt forward edge. Additional inside protective foam material is adhesively secured to the inside of the finger portion to give additional protection.

Another patent of interest is U.S. Pat. No. 3,903,546; which discloses a karate glove with an integral encircling wrist band. A middle loop portion is passed across the palm of the hand and a forward loop or strap is tightened around the fingers. A thumb strap is tightened around the thumb forming a flexible thumb portion around the back of the thumb.

Yet another patent of interest is U.S. Pat. No. 2,574,086; which discloses a tussle glove with a wrist strap, a palm strap and enclosed finger pocket. The thumb is inserted into a thumb socket formed in the glove.

In addition, other patents relating to the present inventive subject matter are U.S. Pat. Nos. 961,149; 1,286,396; 1,627,382; 1,706,503; 2,923,946; 3,258,782; 3,476,108; 3,605,120; 3,741,207; 3,855,633; 3,924,272; 3,945,045; 4,062,073; 4,137,572; 4,287,610; 4,290,147; 4,400,829; 4,497,073; and 4,635,300.

The above-noted references are provided as means for protecting the hands of participants or combatants in karate or contact-type sports. However, the problem with these various prior art devices are that they do not provide sufficient protection at specific stress points and fracture areas of the hands, including the fingers and thumb, and therefore do not effectively prevent the occurrence of various injuries when being used. Furthermore, the gloves of the prior art patents because of their construction wear out or tear at contact and stress points.

The aforementioned invention overcomes these problems with its unique construction and safety features by providing a protective glove adapted to significantly lessen the chance of injury to the hand and to the opponents.

SUMMARY OF THE INVENTION

The present invention is directed to a sports glove for use in contact sports of the martial arts variety comprising a unitary base foam glove body defining a closed finger portion and closed thumb portion into which the fingers of the thumb and hand can be inserted and an elastic strap fastened to the wrist section of the glove body. VELCRO fasteners are attached to opposite sides of the strap, allowing the wrist section to be firmly held around the wrist of the wearer. A hardened shell pad is formed on the glove body in the backhand and knuckle area of the hand to provide a more protective glove of simplified construction which reduces injuries to the hand of the wearer.

One object of the present invention is to provide the sports glove with a specific "shell" or protective pad over the backhand and ridgehand areas to protect the user from fracture or injury.

Another object of the invention is to provide a novel protective glove which permits the hand of the user to be used with the fingers extended or the fingers to be closed into a fist to deliver various types of blows in the martial arts. A further object is to provide the user with a sports glove having a ventilated covered finger area and a covered thumb area which keeps the fingers and thumb from extending out of the glove and being subjected to injury. Furthermore, this design will also prevent injury to the opponent (i.e., thumbs cannot go into the eye, fingernails cannot cut the face.)

Yet another object is to provide a glove with an automically correct design for better circulation.

In the accompanying drawings, there is shown an illustrative embodiment of the invention from which these and other of the objectives, novel features and advantages will be readily apparent.

BRIEF DESCRIPTION OF THE DRAWINGS

FIG. 1 is a perspective view of the glove according to the invention;

FIG. 2 is an enlarged side elevational view of tho glove of FIG. 1;

FIG. 3 is an opposite side elevational view of the glove shown in FIG. 2;

DETAILED DESCRIPTION OF THE DRAWINGS

Figure 5:
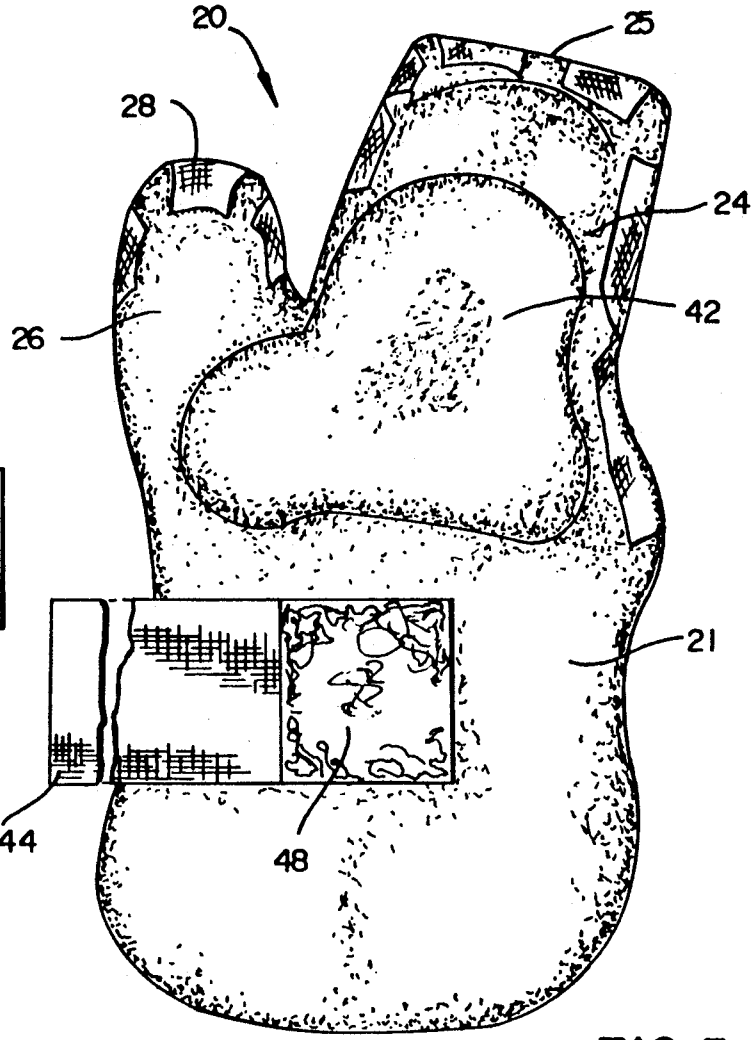
FIG. 5 is a top plan view of the inventive glove with the glove being spread apart.
Figure 4:
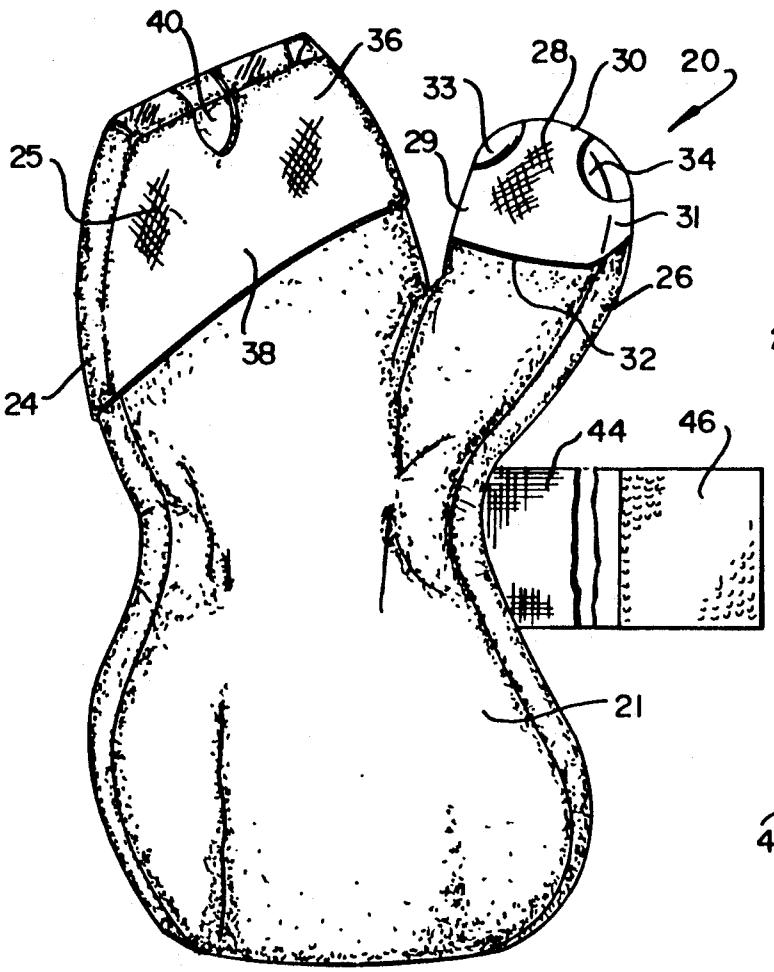
FIG. 4 is a perspective view of the inside of the glove with the glove being spread apart.

The preferred embodiment and best mode of the sports glove is shown in FIGS. 1–5. The glove 20 is shown with a wrist 22 which is adapted to encircle the users wrist, a hand section 24 with associated finger section 25 and a thumb section 26. The unitary glove body 21 is constructed of a resilient substance capable of absorbing energy such as a base foam ½ inch thick of INSOLITE PVC. Such a material absorbs kinetic energy caused by deformation of the foam during a punch. After the end of a punch the load is removed and the integral foam returns to its original form. A T-shaped vinyl member 28 is adhesively glued to the thumb section 26 so that each of the ends 29, 30, and 31 of the T form thumb enclosure 32. This T-shaped member 28 is constructed of nylon-reinforced vinyl and is secured to the glove body 21 with a solvent-based neopreme glue. The thumb enclosure 32 is formed with a T-shaped piece 28 and the glove body thumb section 26 to form apertures 33 and 34, allowing ventilation in the thumb portion.

The finger section 25 is constructed of a specifically shaped vinyl piece 36 which is similarly glued to the finger section 25 of the glove body to form a finger enclosure 38. This finger enclosure 38 is also provided with a centrally positioned aperture 40 allowing ventilation of the enclosed finger area. A protective pad 42 covering the ridgehand area and extending downward on the thumb base is secured to or formed on the back of hand section 24. The protective pad is constructed of a shell foam of ethylvinylacetate ¼ inch thick in thickness having a #1.5 pound low density. This pad forms a protective pad on the back of the hand to protect the back of the hand, knuckles and thumb joint. An elastic strap 44 is secured at one end to the back of the glove wrist 22 by a suitable adhesive. The strap 44 is an elastic weave about 2 inches thick with VELCRO fastener 46 on one end and a VELCRO fastener 48 on the other end on the opposite side of the strap allowing both VELCRO fasteners to mate and hold the wrist section together. The entire glove including vinyl members and protective pad, with the exception of the elastic strap 44, is dipped in a polyvinylchloride coating so that a smooth hardened surface is provided over the entire glove surface. Thus the coating provides a continuous, flexible, tough casing which prevents tearing of the foam during use. It is known in the art that this surface coating can be applied by spraying, dipping or during the heating and molding process.

While various embodiments of the present invention have been shown and described herein for purposes of illustration, it will be apparent that other variations and embodiments are considered to fall within the scope of the defined invention.

What is claimed is:

1. A sports glove for use in contact sports comprising a unitary molded body constructed of a foam base, said body forming a wrist section, a hand section, a finger section and a thumb section, strap means is secured to the wrist section of said glove and is adapted to encircle said glove, fastener means is provided on said strap means so that said strap means can be fastened around said wrist section holding said wrist section around a hand of a user, a thumb means is secured to said thumb section to form enclosure, said thumb means defining aperture means providing ventilation, a finger means is secured to said finger section of said glove to form a finger enclosure, protective padding means is secured to said hand section of said glove covering the back of the hand to give the back of the hand protection, said finger section being capable of being folded together with a portion of the hand section to form a fist.

2. A sports glove as claimed in claim 1 wherein said finger enclosure is provided with a plurality of apertures to provide ventilation of the enclosed area.

3. A sports glove as claimed in claim 1 wherein said fastener means are hook and loop fastener means which are secured to opposite sides of said strap means.

4. A sports glove as claimed in claim 1 wherein said strap means is an elastic strap.

5. A sports glove as claimed in claim 1 wherein said sports glove is coated with a layer of polyvinylchloride.

6. A sports glove as claimed in claim 1 wherein said protective padding means is ¼" thick shell foam.

7. A sports glove as claimed in claim 6 wherein said shell foam is ethyvinylacetate.

8. A sports glove as claimed in claim 1 wherein said foam base is INSOLITE PVC.

9. A sports glove as claimed in claim 1 wherein said thumb means forming a thumb enclosure is a T shaped member constructed of reinforced nylon vinyl.

10. A sports glove as claimed in claim 1 wherein said finger means is constructed of reinforced nylon vinyl.

11. A sports glove for use in contact sports comprising a unitary molded body which is constructed of a resilient foam material with a wrist section, a hand section, said hand section including finger and thumb sections, an elastic strap with fastener means is secured to the wrist section of the glove and is adapted to encircle said glove so that the elastic strap can be fastened around the wrist section holding the wrist section of the glove around a hand of a wearer, a reinforced thumb member is secured to the thumb section, said reinforced thumb member and thumb section forming a thumb enclosure assembly which defines aperture means to provide ventilation, and a reinforced finger member is secured to the hand section of said glove, said reinforced finger member and hand section forming a finger enclosure assembly, a protective pad is secured to a back of the hand section of the glove covering the ridge bones of the hand.

12. A sports glove as claimed in claim 11 wherein said reinforced thumb member is a T shaped member.

13. A sports glove as claimed in claim 11 wherein said sports glove with the exception of the elastic strap is coated with a layer of plastic to present a uniform smooth surface.

14. A sports glove as claimed in claim 11 wherein said finger enclosure assembly defined aperture means to provide ventilation of said finger enclosure assembly.

15. A sports glove for use in contact sports comprising a unitary molded body which is constructed of a resilient foam material with a wrist section, a hand section, said hand section including finger and thumb sections, a strap with fastener means is secured to the wrist section of the glove and is adapted to encircle said glove so that the strap can be fastened around the wrist section holding the wrist section of the glove around a hand of a wearer, a reinforced thumb member is secured to the thumb section, said reinforced thumb member and thumb section forming a thumb enclosure means and defining ventilation means, a reinforced finger member is secured to the hand section of said glove, said reinforced finger member and hand section forming a finger enclosure means which can be formed into a fist by the user, a protective pad is secured to a back of the hand section of the glove covering the ridge bones of the hand to give the back of the hand protection.

* * * * *